US007007868B1

(12) United States Patent
Chen

(10) Patent No.: US 7,007,868 B1
(45) Date of Patent: Mar. 7, 2006

(54) SPRAYING GUN HAVING MULTI-STATE WATER FLOW CONTROL EFFECT

(75) Inventor: Chin-Yuan Chen, Lu Kang Chen (TW)

(73) Assignee: Shin Tai Spurt Water of the Garden Tools Co., Ltd., Lu Kang Chen (TW)

( * ) Notice: Subject to any disclaimer, the term of this patent is extended or adjusted under 35 U.S.C. 154(b) by 0 days.

(21) Appl. No.: 10/888,058

(22) Filed: Jul. 9, 2004

(51) Int. Cl.
*B05B 7/02* (2006.01)

(52) U.S. Cl. ..... 239/525; 239/526; 239/586; 239/530

(58) Field of Classification Search ..... 239/525, 239/526, 586, 530
See application file for complete search history.

(56) References Cited

U.S. PATENT DOCUMENTS 3,888,421 A * 6/1975 Chow ..... 239/456
4,083,497 A * 4/1978 Rosenberger ..... 239/526
4,619,403 A * 10/1986 Goldney et al. ..... 239/456
5,984,207 A * 11/1999 Wang ..... 239/526
6,454,187 B1 * 9/2002 Wang ..... 239/526
6,471,145 B1 * 10/2002 Huang ..... 239/526
6,520,427 B1 * 2/2003 Chen ..... 239/526
6,540,159 B1 * 4/2003 Wang ..... 239/525

* cited by examiner

*Primary Examiner*—David A. Scherbel
*Assistant Examiner*—Seth Barney
(74) *Attorney, Agent, or Firm*—Alan D. Kamrath; Nikolai & Mersereau, P.A.

(57) ABSTRACT

A spraying gun includes a gun body, a water guide pipe, a water control bar, and a water control switch. Thus, the driven portion of the water control bar is pushed by either one of the engaging portions of the eccentric urging face of the water control switch, so that the water control bar is moved in the receiving space of the water guide pipe step by step so as to control the water flow in the water guide pipe in a multi-stage manner, thereby facilitating the user regulating the water flow rate of the spraying gun so as to save the water source.

10 Claims, 4 Drawing Sheets

SPRAYING GUN HAVING MULTI-STATE WATER FLOW CONTROL EFFECT

BACKGROUND OF THE INVENTION

1. Field of the Invention

The present invention relates to a spraying gun, and more particularly to a spraying gun having a multi-stage water flow control effect so as to save the water source.

2. Description of the Related Art

A conventional spraying gun comprises a gun body having an inside formed with a water channel having a first end connected to a water inlet pipe and a second end connected to a nozzle, a water control unit mounted in the water channel to open or close the water channel and having a distal end protruding outward from the gun body, and a press lever pivotally mounted on the gun body and connected to the distal end of the water control unit. When the press lever is pressed toward the gun body, the water control unit is moved by pivot of the press lever to open the water channel, so that water contained in the water channel is injected outward from the nozzle. However, the water flow rate injected outward from the nozzle cannot be controlled and regulated, thereby wasting the water source.

SUMMARY OF THE INVENTION

In accordance with the present invention, there is provided a spraying gun, comprising:

a hollow gun body;

a water guide pipe mounted in the gun body and having an inside formed with a receiving space;

a water control bar movably mounted in the receiving space of the water guide pipe to control a water flow in the water guide pipe and having a first end formed with a driven portion protruding outward from the receiving space of the water guide pipe; and a water control switch pivotally mounted on the gun body and having a first side formed with an eccentric urging face rested on the driven portion of the water control bar and a second side formed with a drive portion.

The primary objective of the present invention is to provide a spraying gun having a multi-stage water flow control effect so as to save the water source.

Another objective of the present invention is to provide a spraying gun, wherein the driven portion of the water control bar is pushed by either one of the engaging portions of the eccentric urging face of the water control switch, so that the water control bar is moved in the receiving space of the water guide pipe step by step so as to control the water flow in the water guide pipe in a multi-stage manner, thereby facilitating the user regulating the water flow rate of the spraying gun so as to save the water source.

A further objective of the present invention is to provide a spraying gun, wherein the driven portion of the water control bar is locked in either one of the engaging portions of the eccentric urging face of the water control switch, so that the water control switch is combined with the water control bar exactly so as to control the water flow rate of the spraying gun exactly and smoothly.

Further benefits and advantages of the present invention will become apparent after a careful reading of the detailed description with appropriate reference to the accompanying drawings.

DETAILED DESCRIPTION OF THE INVENTION

Figure 1:
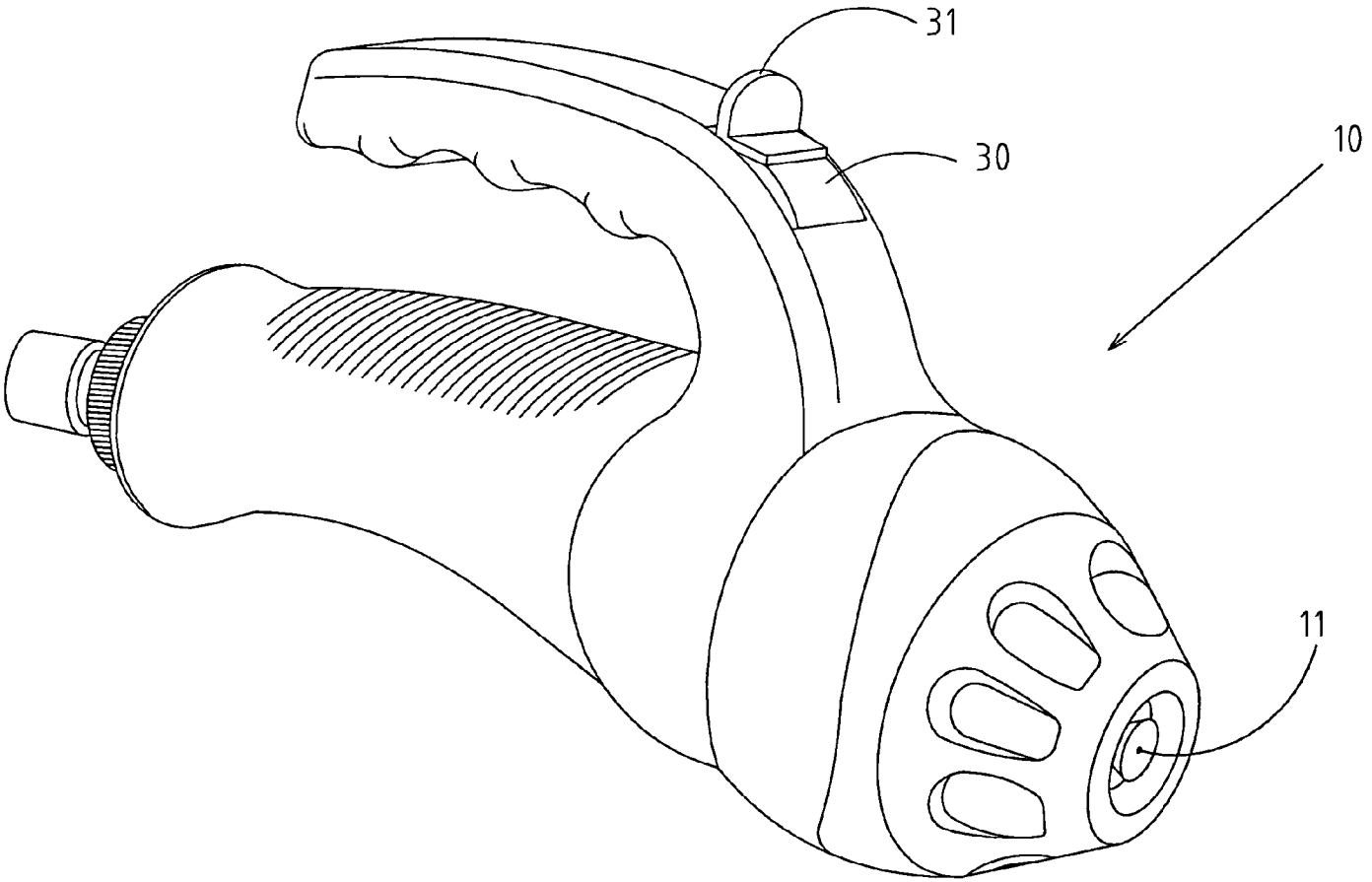
FIG. 1 is perspective view of a spraying gun in accordance with the preferred embodiment of the present invention.
Figure 2:
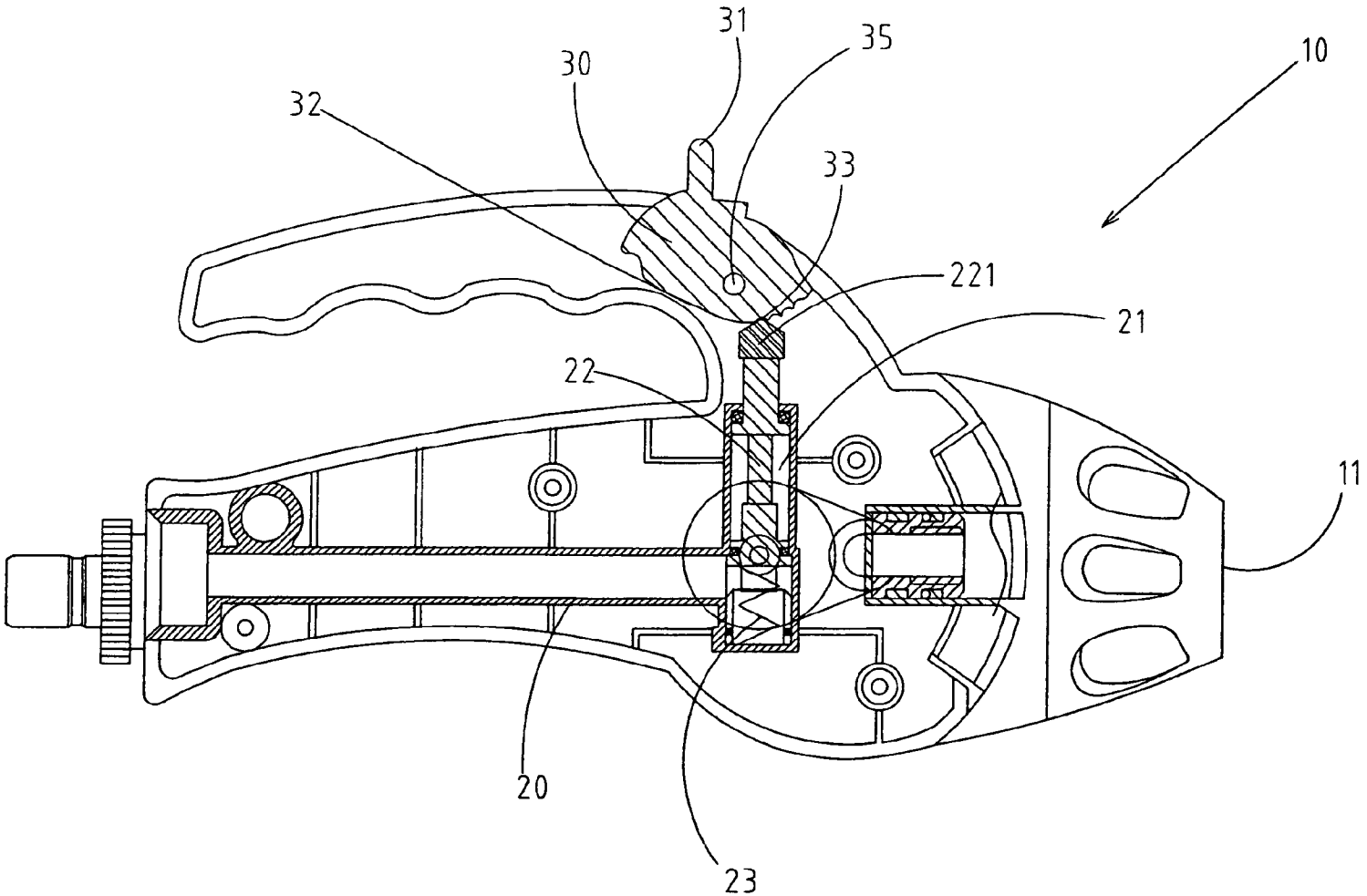
FIG. 2 is a plan cross-sectional view of the spraying gun as shown in FIG. 1.
Figure 3:
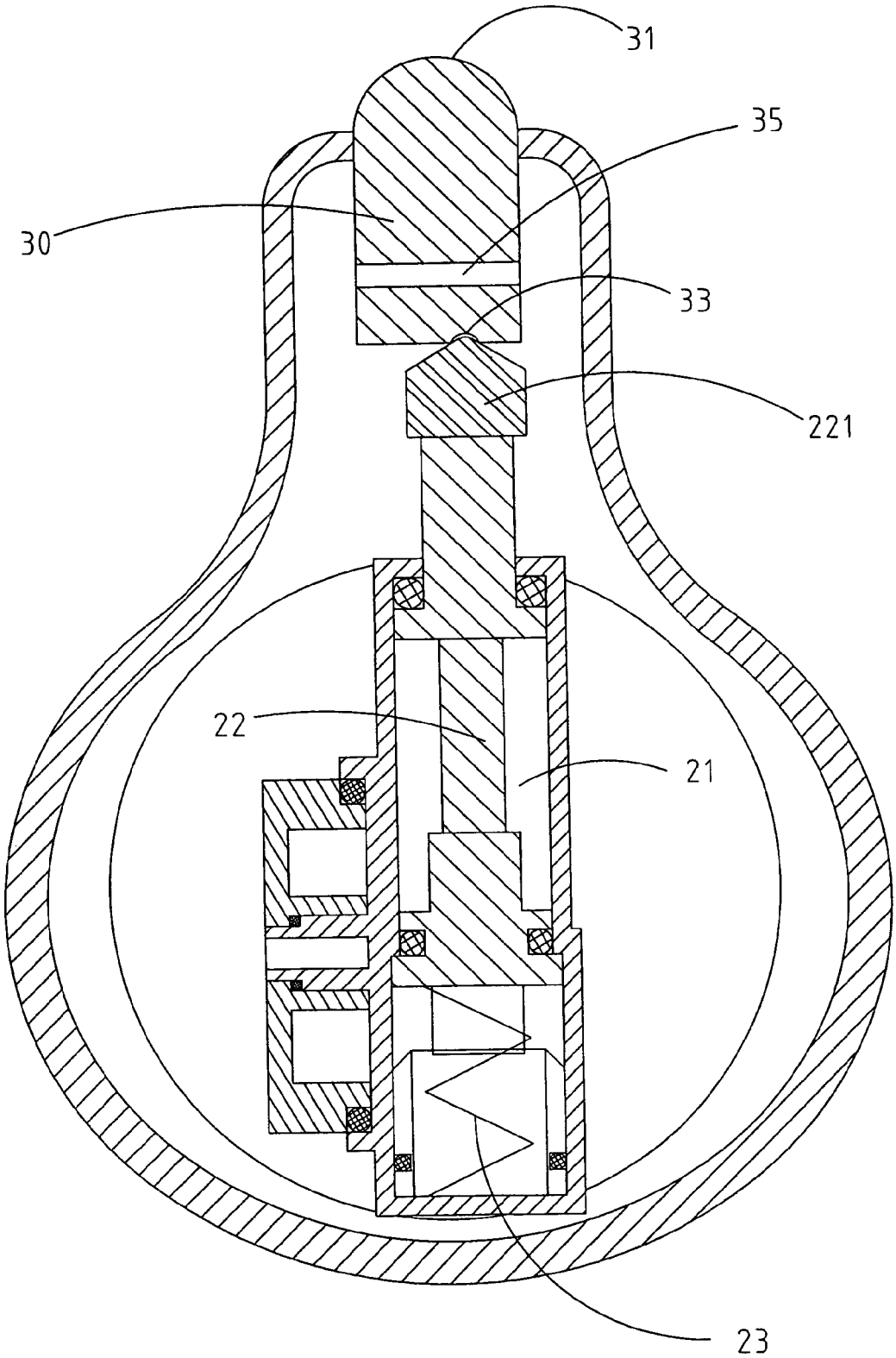
FIG. 3 is a plan cross-sectional view of the spraying gun as shown in FIG. 1.

Referring to the drawings and initially to FIGS. 1–3, a spraying gun in accordance with the preferred embodiment of the present invention comprises a hollow gun body 10, a water guide pipe 20 mounted in the gun body 10 and having an inside formed with a receiving space 21, a water control bar 22 movably mounted in the receiving space 21 of the water guide pipe 20 to control a water flow in the water guide pipe 20 and having a first end formed with a wedge-shaped driven portion 221 protruding outward from the receiving space 21 of the water guide pipe 20, an elastic member 23 mounted in the receiving space 21 of the water guide pipe 20 and urged between a second end of the water control bar 22 and the water guide pipe 20, and a water control switch 30 pivotally mounted on the gun body 10 in an eccentric manner and having a first side formed with an eccentric urging face 32 rested on the driven portion 221 of the water control bar 22 and a second side formed with a drive portion 31.

The water guide pipe 20 has a first end connected to a water outlet port 11 of the gun body 10 and a second end connected to a water inlet tube (not shown).

The water control switch 30 is an eccentric cam and has a pivot portion 35 pivotally mounted on the gun body 10 in an eccentric manner. The distance between the drive portion 31 and the pivot portion 35 of the water control switch 30 is greater than that between the eccentric urging face 32 and the pivot portion 35 of the water control switch 30.

The eccentric urging face 32 of the water control switch 30 is formed with a plurality of tooth-shaped engaging portions 33 located adjacent to each other, and the driven portion 221 of the water control bar 22 is engaged with and pushed by either one of the engaging portions 33 of the eccentric urging face 32 of the water control switch 30 when the water control switch 30 is pivoted on the gun body 10, so that the water control bar 22 is moved in the receiving space 21 of the water guide pipe 20 by pivot of the water control switch 30 so as to control the water flow in the water guide pipe 20.

Figure 4:
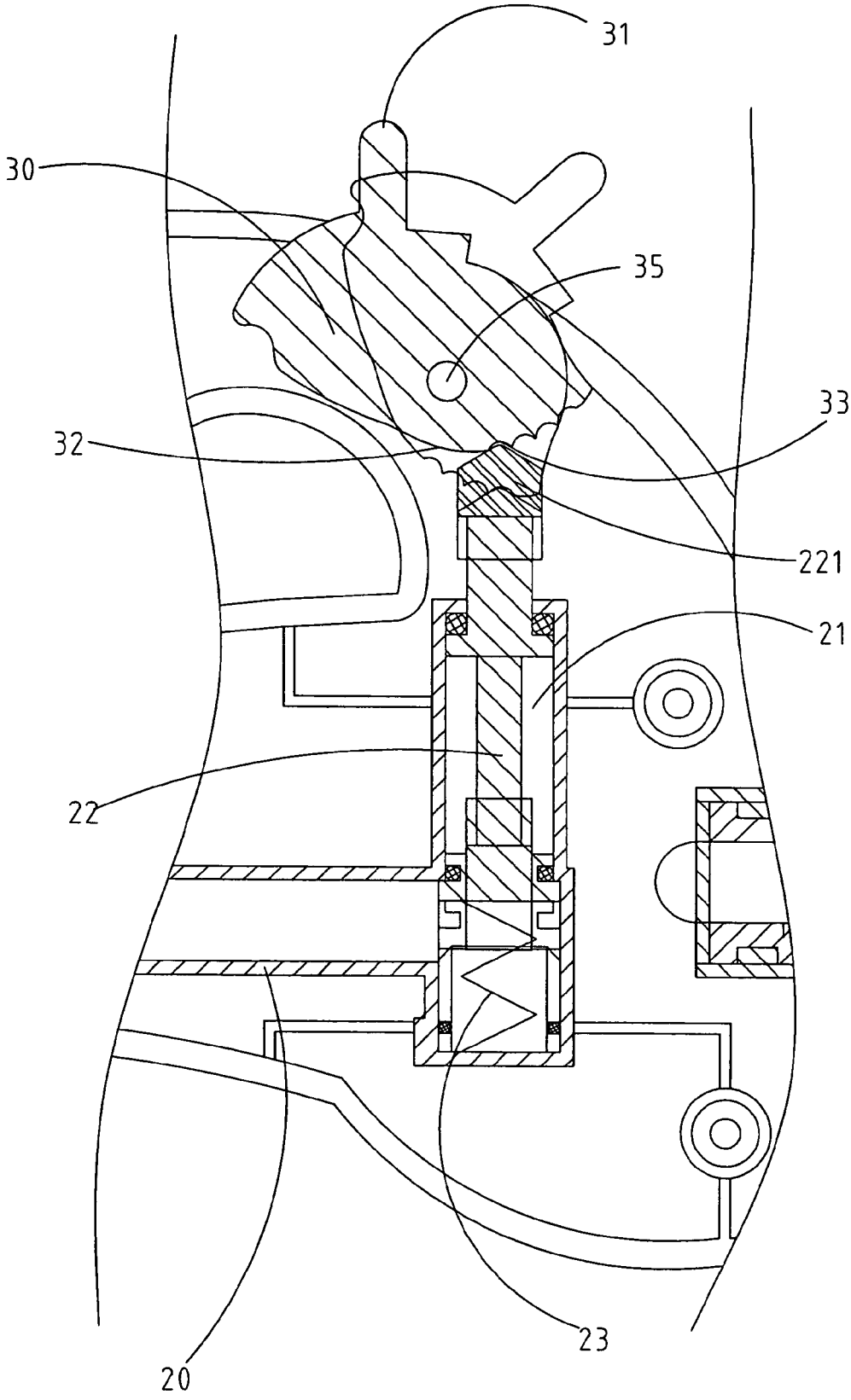
FIG. 4 is a partially cut-away plan cross-sectional operational view of the spraying gun as shown in FIG. 1.

In operation, referring to FIG. 4 with reference to FIGS. 1–3, when the drive portion 31 of the water control switch 30 is moved by a user, the water control switch 30 is pivoted on the gun body 10 in an eccentric manner to move the eccentric urging face 32 which moves the engaging portions 33 in an eccentric manner.

In such a manner, the driven portion 221 of the water control bar 22 is engaged with and pushed by either one of the engaging portions 33 of the eccentric urging face 32 of the water control switch 30 when the water control switch 30 is pivoted on the gun body 10, so that the water control bar 22 is moved in the receiving space 21 of the water guide pipe 20 by pivot of the water control switch 30 so as to control the water flow in the water guide pipe 20.

Accordingly, the driven portion 221 of the water control bar 22 is pushed by either one of the engaging portions 33 of the eccentric urging face 32 of the water control switch 30, so that the water control bar 22 is moved in the receiving space 21 of the water guide pipe 20 step by step so as to control the water flow in the water guide pipe 20 in a multi-stage manner, thereby facilitating the user regulating the water flow rate of the spraying gun so as to save the water source. In addition, the driven portion 221 of the water control bar 22 is locked in either one of the engaging portions 33 of the eccentric urging face 32 of the water control switch 30, so that the water control switch 30 is combined with the water control bar 22 exactly so as to control the water flow rate of the spraying gun exactly and smoothly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spraying gun, comprising:

a hollow gun body;

a water guide pipe mounted in the gun body and having an inside formed with a receiving space;

a water control bar movably mounted in the receiving space of the water guide pipe to control a water flow in the water guide pipe and having a first end formed with a driven portion protruding outward from the receiving space of the water guide pipe;

a water control switch pivotally mounted on the gun body and having a first side having a periphery formed with an eccentric urging face rested on the driven portion of the water control bar and a second side formed with a drive portion;

wherein the eccentric urging face of the water control switch is formed with a plurality of tooth-shaped recessed engaging portions, and the driven portion of the water control bar is engaged with one of the plurality of tooth-shaped engaging portions of the eccentric urging face of the water control switch.

2. The spraying gun in accordance with claim 1, wherein the driven portion of the water control bar is wedge-shaped.

3. The spraying gun in accordance with claim 1, further comprising an elastic member mounted in the receiving space of the water guide pipe and urged between a second end of the water control bar and the water guide pipe.

4. The spraying gun in accordance with claim 1, wherein the water control switch is pivotally mounted on the gun body in an eccentric manner.

5. The spraying gun in accordance with claim 1, wherein the water control switch is an eccentric cam.

6. The spraying gun in accordance with claim 1, wherein the water control switch has a pivot portion pivotally mounted on the gun body in an eccentric manner relative to a central portion of the water control switch.

7. The spraying gun in accordance with claim 6, wherein the pivot portion of the water control switch is located between the drive portion and the eccentric urging face, and the distance between the drive portion and the pivot portion of the water control switch is greater than that between the eccentric urging face and the pivot portion of the water control switch.

8. The spraying gun in accordance with claim 1, wherein the driven portion of the water control bar is pushed by either one of the engaging portions of the eccentric urging face of the water control switch when the water control switch is pivoted on the gun body, so that the water control bar is moved in the receiving space of the water guide pipe by pivot of the water control switch so as to control the water flow in the water guide pipe.

9. The spraying gun in accordance with claim 1, wherein the engaging portions of the eccentric urging face of the water control switch are located adjacent to each other.

10. The spraying gun in accordance with claim 1, wherein the driven portion of the water control bar is pushed by either one of the engaging portions of the eccentric urging face of the water control switch when the water control switch is pivoted on the gun body, so that the water control bar is moved in the receiving space of the water guide pipe step by step by pivot of the water control switch so as to control the water flow in the water guide pipe in a multi-stage manner.

* * * * *